US008764481B2

(12) United States Patent
Matsumoto et al.

(10) Patent No.: US 8,764,481 B2
(45) Date of Patent: Jul. 1, 2014

(54) DIRECT MOUNT CONNECTOR TERMINAL AND DIRECT MOUNT CONNECTOR

(75) Inventors: Mitsuhiro Matsumoto, Makinohara (JP); Hajime Kato, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 112 days.

(21) Appl. No.: 13/393,896

(22) PCT Filed: Jul. 14, 2010

(86) PCT No.: PCT/JP2010/061882

§ 371 (c)(1),
(2), (4) Date: Mar. 2, 2012

(87) PCT Pub. No.: WO2011/027620

PCT Pub. Date: Mar. 10, 2011

(65) Prior Publication Data

US 2012/0164867 A1 Jun. 28, 2012

(30) Foreign Application Priority Data

Sep. 7, 2009 (JP) ..... 2009-205579

(51) Int. Cl.
*H01R 13/40* (2006.01)

(52) U.S. Cl.
USPC ..... 439/595

(58) Field of Classification Search
CPC ..... H01R 13/4223; H01R 13/4226; H01R 13/5202
USPC ..... 439/34, 559, 587, 595, 345
See application file for complete search history.

(56) References Cited

U.S. PATENT DOCUMENTS 1,880,511 A 10/1932 Soreny
4,738,631 A 4/1988 Takahashi et al.

(Continued)

FOREIGN PATENT DOCUMENTS

CN 1177849 A 4/1998
JP 10-079269 A 3/1998
JP 10-112361 A 4/1998
JP 2008-041442 A 2/2008

OTHER PUBLICATIONS

Notification of Reason for Refusal mailed May 28, 2013, issued for the corresponding Japanese patent application No. 2009-205579 and English translation thereof.

(Continued)

*Primary Examiner* — Xuong Chung Trans
(74) *Attorney, Agent, or Firm* — Edwards Wildman Palmer LLP; James E. Armstrong, IV; Jonathon P. Western

(57) ABSTRACT

The present invention is to provide a direct mount connector terminal and a direct mount connector for improving reliability of connection thereof. The direct mount connector terminal is locked to a connector housing with a lance of the connector housing. The direct mount connector terminal includes an electrical connection portion extending toward a connection direction of a mating terminal, a bent portion connected to and bent with respect to the electrical connection portion, a parallel portion connected to the bent portion and parallel to the electrical connection portion, and a locking portion disposed on the parallel portion and to be locked to the lance of the connector housing.

3 Claims, 7 Drawing Sheets

(56) References Cited

U.S. PATENT DOCUMENTS

| | | | | |
|---|---|---|---|---|
| 5,980,328 | A * | 11/1999 | Takanashi et al. | 439/733.1 |
| 6,059,594 | A * | 5/2000 | Davis et al. | 439/275 |
| 7,097,498 | B2 * | 8/2006 | Miyazaki | 439/559 |
| 7,268,300 | B2 * | 9/2007 | Miyazaki | 174/138 F |
| 7,722,372 | B2 * | 5/2010 | Matsumoto et al. | 439/213 |

OTHER PUBLICATIONS

International Search Report dated Aug. 10, 2010, issued for PCT/JP2010/061882.

European Search Report, European Application No. 10 813 571.6, mailed Mar. 4, 2004, 5 pages, European Patent Office, Rijswijk, Netherlands.

* cited by examiner

PRIOR ART

PRIOR ART

DIRECT MOUNT CONNECTOR TERMINAL AND DIRECT MOUNT CONNECTOR

TECHNICAL FIELD

The present invention relates to a direct mount connector terminal locked to a connector housing and allowing direct mounting of a mating terminal, and a direct mount connector having the direct mount connector terminal.

RELATED ART

Referring to JP 2008-41442 A, a board mount connector of a printed board includes a holder or a housing receiving a plurality of terminals press-inserted or integrally formed therein. One end portions of the terminals are projecting in a connector housing toward mating terminals to be connected and another end portions of the terminals are connected to the printed board.

On the contrary to the board mount connector, a device-direct mount connector has a direct mount connector terminal locked to a housing with a lance in the housing. This configuration causes disengagement of the direct mount connector terminal from the housing when a male and a female terminal are fitted together and the mating terminal pushes the direct mount connector terminal. Referring to FIGS. 7 and 8, a conventional device-direct mount connector 100 has a device-mount female connector 110 and a wiring harness male connector 120. The female connector 110 has a female terminal 111, a female housing 112, a housing lance 113 and a current sensor 114.

The female terminal 111 is received and held in the female housing 112 with locking between the housing lance 113 and a locking hole 115. The current sensor 114 measures a current value flowing in the female terminal 111 at a current measurement portion 116 of the female terminal 111. The male connector 120 has a male terminal 121 electrically connected to a wiring harness and a male housing 122 receiving the male terminal 121.

Referring to FIG. 8, the device-direct mount connector 100 is assembled by approaching the female connector 110 and the male connector 120 each other, fitting the female housing 112 to the male housing 122, and inserting the male terminal 121 into the female housing 111 to be fitted to the female terminal 111 in order to achieve an electrical connection.

The conventional device-direct mount connector 100 has a drawback when the male connector 100 is fitted to the female connector 120. When a force with a direction F in FIG. 8 applied to the male connector 120 is excessive, the male terminal 121 pushes the female terminal 111 in the same direction F and may damage the housing lance 113 in the worst case. The damage of the housing lance 113 may cause disengagement of the female terminal 111 from the female housing 112 and reduce reliability of the electrical connection.

In order to solve this drawback, the female terminal 111 may be fastened to the female housing 112 with a screw. However, this treatment increases steps of production and a number of parts, resulting in increase of production cost. The female terminal 111 may be press-formed or integrally formed in the female housing 112 as the board mount connector. However, this configuration prevents miniaturization and lightweight of the female housing 112. The device-direct mount connector 110 having the current sensor 114 has another drawback. When the female terminal 111 disengages from the female housing 112 and the current sensor 114 is displaced from the current measurement portion 116 of the female terminal 111, it is not possible to measure the value of the current.

DISCLOSURE OF THE INVENTION

An object of the present invention is to provide a direct mount connector terminal and a direct mount connector for preventing the direct mount connector terminal from disengaging from a lance of a connector housing and for improving a reliability of connection thereof.

According to a first object of the present invention, a direct mount connector terminal to be locked to a connector housing with a lance of the connector housing includes an electrical connection portion extending toward a connection direction of a mating terminal, a bent portion connected to and bent with respect to the electrical connection portion, a parallel portion connected to the bent portion and parallel to the electrical connection portion, and a locking portion disposed on the parallel portion and to be locked to the lance of the connector housing.

When the electrical connection portion contacts the mating terminal and a force is exerted on the electrical connection portion in the connection direction, the electrical connection portion is subjected to the force toward the parallel portion. The bent portion disposed between the electrical connection portion and the parallel portion deforms to disperse the force so that the locking portion of the parallel portion is not subjected to the force.

Preferably, the direct mount connector terminal further includes a current measurement portion connected to the parallel portion and allowing measurement of a current flowing the direct mount connector terminal.

The force exerted on the electrical connection portion from the mating terminal is dispersed with the bent portion. Thereby, the parallel portion and the electrical measurement portion are held in place when the direct mount connector terminal contacts the mating terminal.

According to a second object of the present invention, a direct mount connector includes the direct mount connector terminal and the connector housing, wherein the connector housing has the lance to be locked to the locking portion of the direct mount connector terminal.

The lance of the connector housing is locked to the locking portion formed on the parallel portion of the direct mount connector terminal so that the locking portion is not subjected to the force from the mating terminal and the lance of the connector housing is not subjected to the force due to the fitting-force of the connector.

BEST MODE FOR CARRYING OUT THE INVENTION

FIGS. 1-6 illustrate an embodiment of a direct mount connector terminal and a direct mount connector of the present invention.

Figure 1:
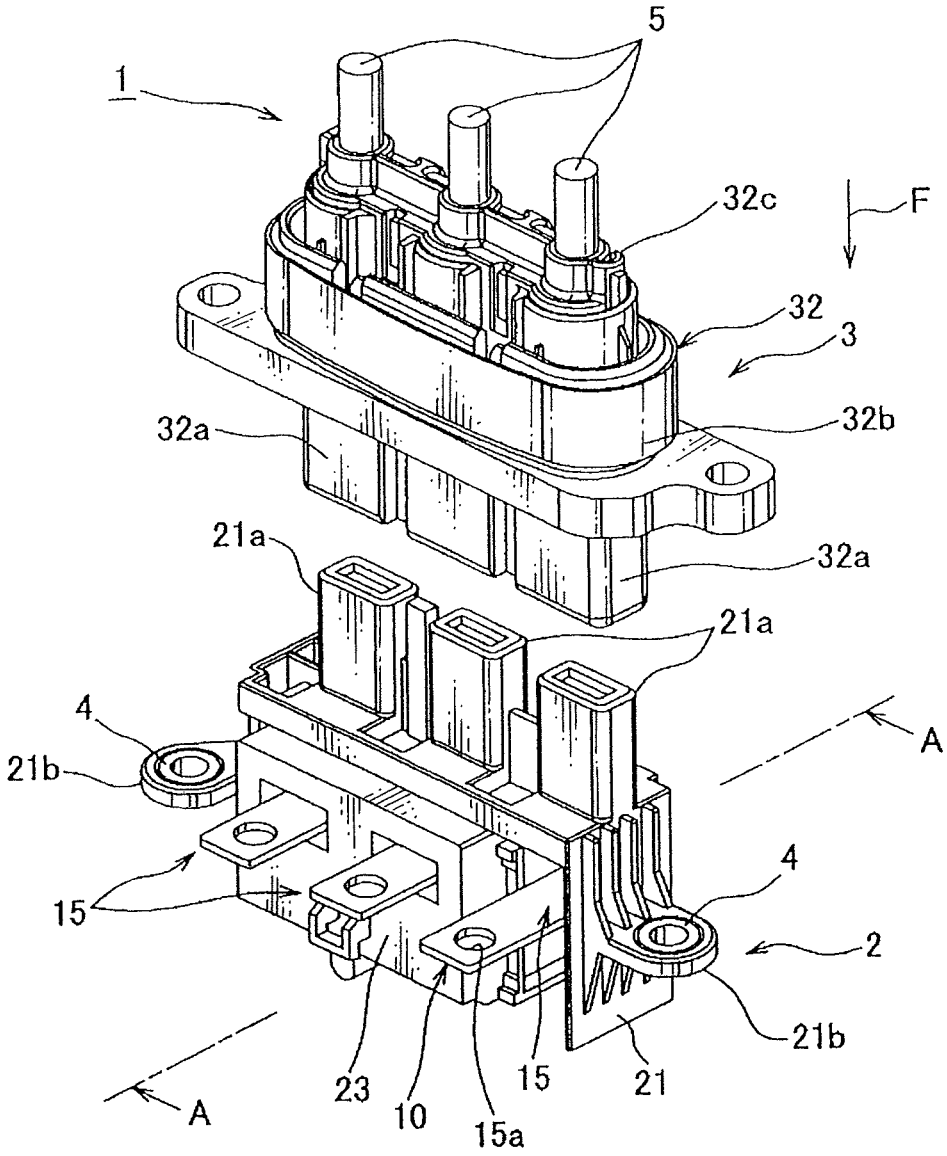
FIG. 1 is an exploded perspective view of a direct mount connector having a direct mount connector terminal of the present invention.

Referring to FIG. 1, a connector 1 includes a female connector 2 connected to a device and a male connector 3 connected to a wiring harness. The female connector 2 and the male connector 3 are approached one another and fitted together. The connector 1 is utilized in an electric vehicle or a hybrid electric vehicle (HEV).

The female connector 2 corresponds to the direct mount connector of the present invention. The female connector 2 includes a plurality of female terminals 10 (three in FIG. 1), each of which corresponds to the direct mount connector terminal of the present invention, a female housing 21 corresponding to a connector housing of the present invention, a plurality of lances 22, and a current sensor 23. Another embodiment has a configuration of the female connector 2 separated from the current sensor 23.

Figure 2:
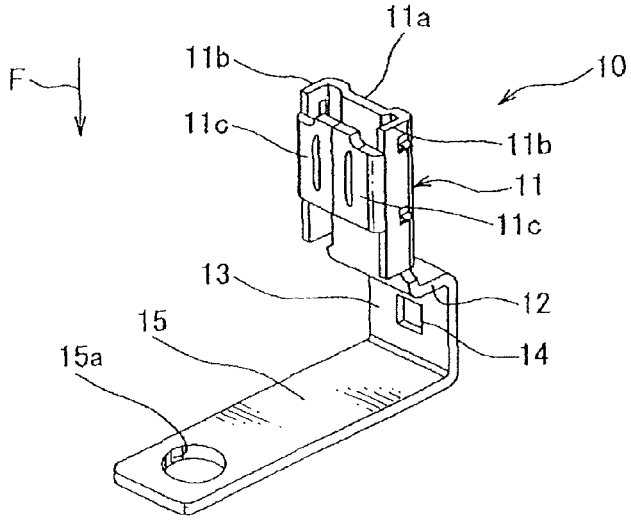
FIG. 2 is a perspective view of the direct mount connector terminal of the present invention.
Figure 3:
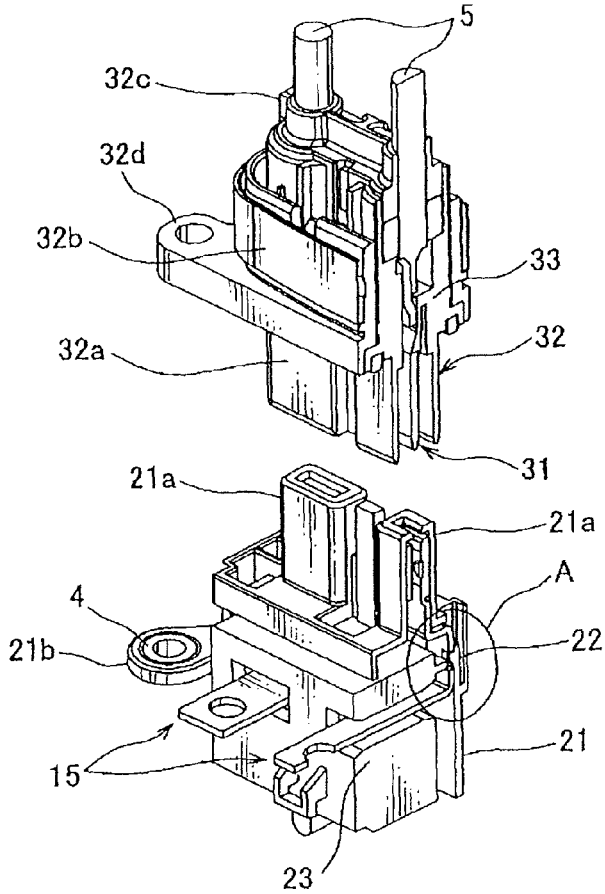
FIG. 3 is a sectional perspective view taken along a line A-A of FIG. 1.
Figure 4:
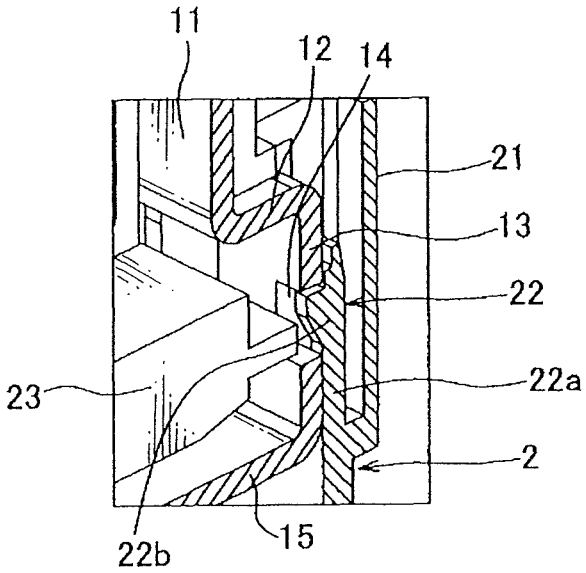
FIG. 4 is an enlarged view of a portion A of FIG. 3.

Referring to FIGS. 3-4, the female terminals 10 are each locked to the female housing 21 with the associated lance 22 of the female housing 21. As shown in FIG. 2, the female terminal 10 has an electrical connection portion 11, a bent portion 12, a parallel portion 13, a locking portion 14, and a current measurement portion 15. All portions thereof are integrally formed with a conductive metal.

The electrical connection portion 11 has a base portion 11*a* extending along a connection direction F for accepting a male terminal 31 of the mating male connector 3, wall portions 11*b* upstanding from side end portions and extending to the connection direction F of the base portion 11*a*, and ceiling portions 11*c* extending from end portions of the wall portions 11 and covering the base portion 11*a*. The base portion 11*a*, the wall portions 11*b*, and the ceiling portions 11*c* of the electrical connection portion 11 define a chamber. The chamber receives the male terminal of the male connector 3 to make the electrical connection therewith.

The bent portion 12 has a plate shape, and is connected to and bent with respect to the electrical connection portion 11. The embodiment of the present invention shows that the bent portion 12 is bent at a right angle with respect to the electrical connection portion 11. It is apparent that the angle may not be limited thereto and may be obtuse or acute angle.

The parallel portion 13 is connected to the bent portion 12 and disposed parallel to the electrical connection portion 11. The parallel portion 13 has a plate shape and extends along the connection direction F. The parallel portion 13 has a through hole as the locking portion 14 at the center thereof. The locking portion 14 is locked with the lance 22 of the female housing 21 and is positioned in place against the female housing 21.

The current measurement portion 15 has a plate shape and is connected to the parallel portion 13 with almost the right angle. End portions of the current measurement portions 15 each project outwardly from the female housing when they are received in the female housing 21. A through hole 15*a* is disposed on the end portion of the each current measurement portion 15 and connected with a terminal (not shown) of the device. The each current measurement portion 15 is covered with the current sensor 23 as shown in FIG. 1 to measure the current flowing the female terminal 10.

The female housing 21 is made of a synthetic resin and has a box shape. The female housing 21 has a plurality of receiving portions 21*a*, which receive the respective male terminals 10, projecting from a housing main body, and a pair of projection portions 21*b* to fix the female housing 21 to a mating member. The receiving portions 21*a* receive the electrical connection portions 11 of the female terminals 11 therein. Each of the projection portions 21*b* has a press-formed metal collar 4 to accept a bolt. The collars 4 prevent bite of the bolts into the female housing 21 or the deformation of the bolts due to chipping of the female housing 21 or fastening of the bolts.

The lances 22 are integral with the female housing 21, and function as springs to lock the female terminals 10 to the female housing 21. Each lance 22 has a plate-shaped resilient portion 22*a* and a locking projection portion 22*b* projecting from a surface of the resilient portion 22*a* toward the female terminal 10. When the each female terminal 10 is received in and positioned in place about the female housing 21, the locking projection portion 22*b* enters the locking portion 14 of the female terminal 10 and is locked to the locking portion 14.

The current sensor 23 such as a known hall current sensor, a clamp type current sensor, or the like is fixed to the female housing 21 with a projection and the like. The current sensor 23 detects the current flowing the female terminals 10 and outputs the current value to a motor drive controller, a direct current conversion controller of a motor regenerative current, and a variety of controllers (not shown).

Figure 5A:
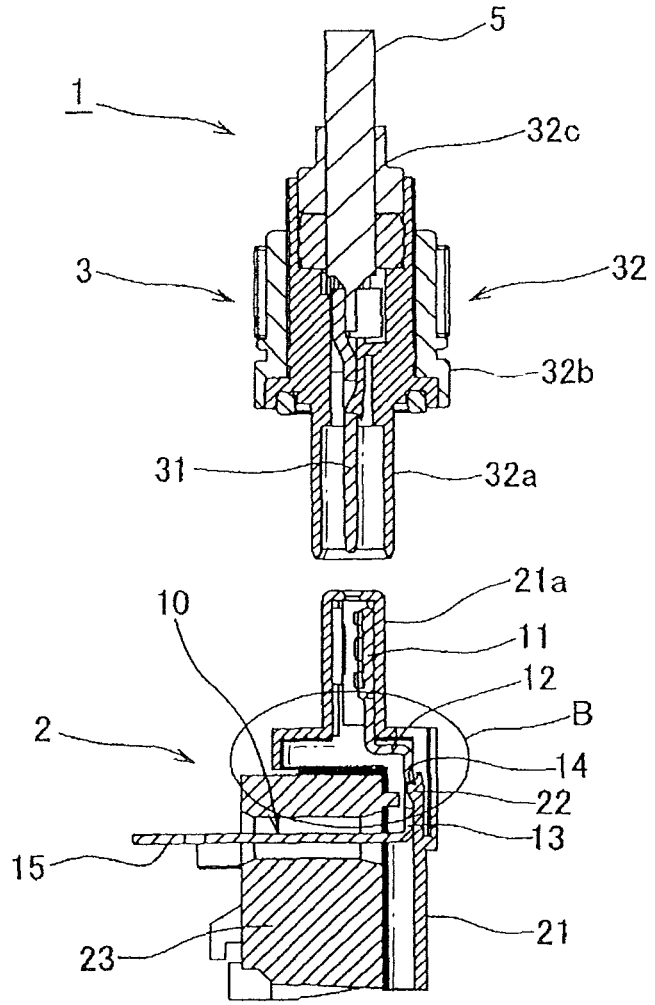
FIG. 5A is a sectional view of a connector showing that the direct mount connector terminal is ready to be fitted.
Figure 5B:
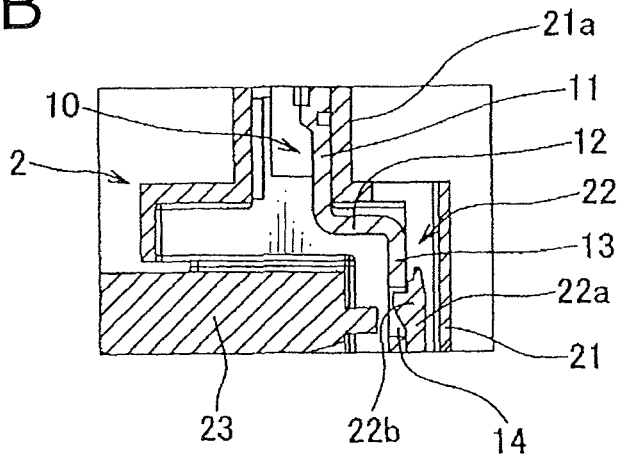
FIG. 5B is an enlarged view of a portion B of FIG. 5A.

The male connector 3 has the male terminals 31, and the male housing 32 to receive the male terminals 31, see for example FIGS. 3 and 5. The male terminals 31 are made of a conductive material and have a plate shape. One end portion of each male terminal 31 is fitted into and electrically connected to the electrical connection portion of the associated female terminal 10. Another end portion of the male terminal 31 is electrically connected to a core wire of an electrical wire 5. The electrical wire 5 is a sheathed electrical wire.

The male housing 32 has a plurality of fitting portions 32*a*, a holding portion 32*b*, and guiding portions 32*c*. The fitting portions 32*a* are fitted to the receiving portions 21*a* of the female housing 21. The holding portion 32*b* holds the male terminals 31 and the core wires of the electrical wires 5 to be electrically connected together. The holding portion 32*b* has fixing portions 32*d* facing the projection portions 21*b* of the female housing 21 so that the fixing portions 32*d* and the projection portions 21*b* are fixed together with the bolt. The guiding portions 32*c* guide the electrical wires 5, which are held with the holding portion 32*b*, outwardly of the male housing 31.

Assembly of the male terminals 10 of the male connector 2 to the male housing 21 is explained below.

The female terminals 10 are received in the female housing 21 so that the electrical connection portion 11 of each female terminal 10 is received in the associated receiving portion 21*a* of the female housing 21. The parallel portion 13 of the each female terminal 10 is positioned in the female housing 21 so that the parallel portion 13 abuts on an inner wall of the female housing 21. The electrical connection portion 11 is further pushed into the receiving portion 21*a*. The locking portion 14 of the parallel portion 13 and the lance 22 of the female housing are locked together, and the female terminal 10 is locked to the female housing 21. The female terminals 10 of the present invention are locked to the female housing 21 without press-insertion to the female housing 21 and without integral forming with the female housing 21.

The assembly of the female connector 2 and the male connector 3 of the connector 1 is explained below.

Figure 6A:
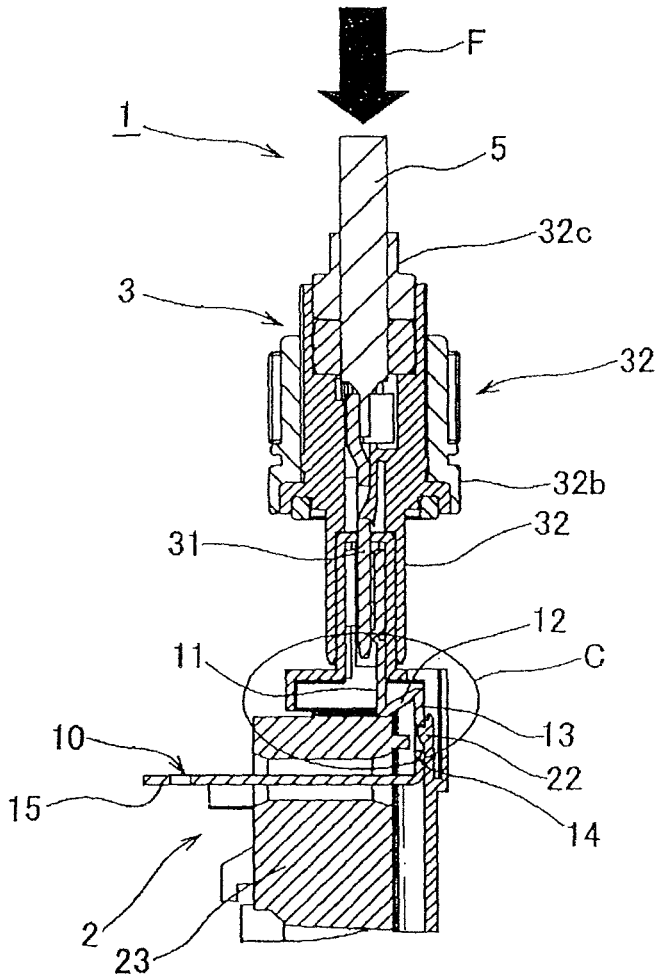
FIG. 6A is a sectional view of the connector showing that the direct mount connector terminal is fitted.
Figure 6B:
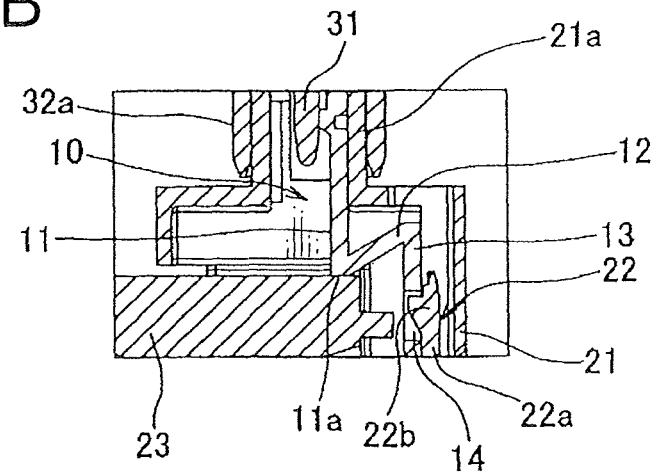
FIG. 6B is an enlarged view of a portion C of FIG. 6A.
Figure 7A:
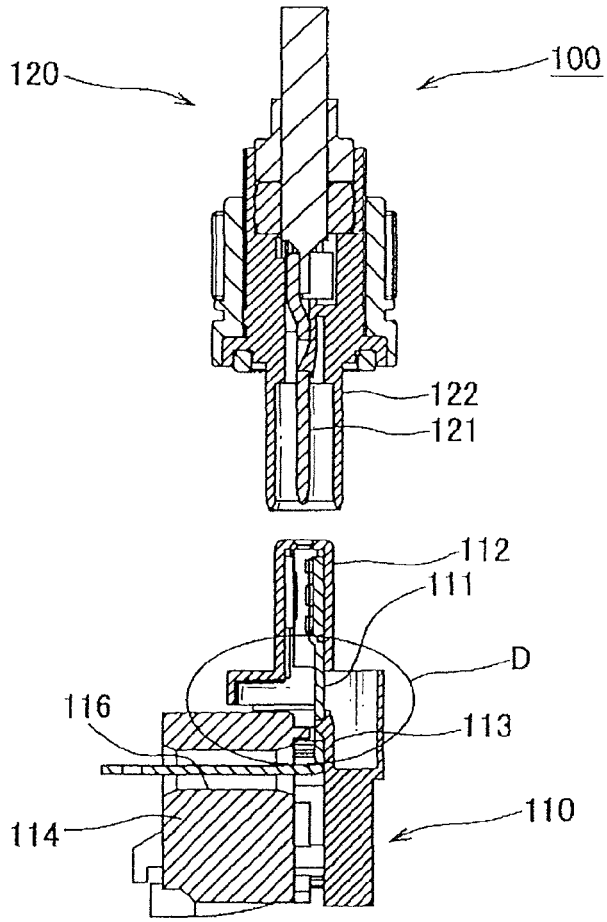
FIG. 7A is a sectional view of a conventional device-direct mount connector showing that the connector is ready to be fitted.
Figure 7B:
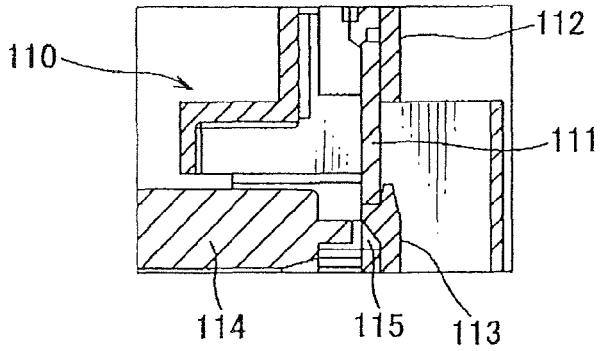
FIG. 7B is an enlarged view of a portion D of FIG. 7A.
Figure 8A:
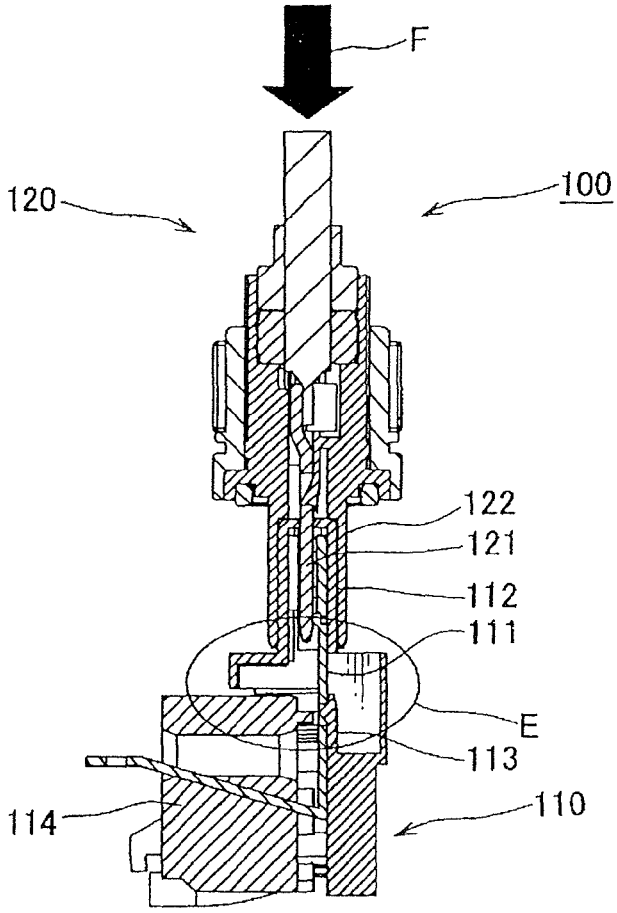
FIG. 8A is a sectional view of the conventional connector showing that the connector is fitted.
Figure 8B:
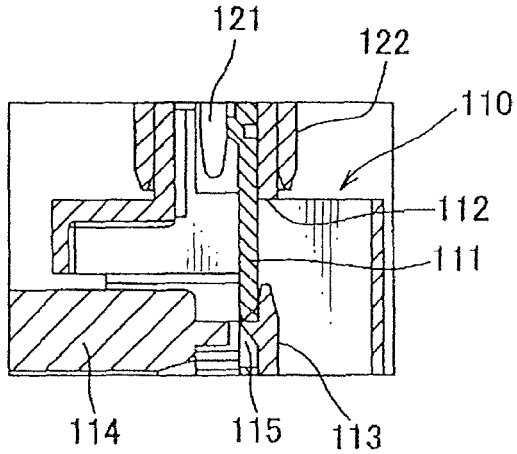
FIG. 8B is an enlarged view of a portion E of FIG. 8A.

Referring to FIG. 5A, the female connector 2 and the male connector 3 are approached together so that each receiving portion 21*a* of the female housing 21 enters into each fitting portion 32*a* of the male housing 32 and each male terminal 31 enters into the associated electrical connection portion 11 of the female terminal 10. With further approaching between the female connector 2 and the male connector 3, the each male terminal 31 further enters into the associated electrical connection portion 11 of the female terminal 10. The bent portion 12 of the female terminal 10 gradually deforms and is force-pushed in the connection direction F together with the male terminal 31 (see FIG. 6A). The each receiving portion 21*a* of the female housing 21 is then completely fitted into the fitting portion 32*a* of the male housing 32. As shown in FIG. 6B, each base portion 11*a* of the electrical connection portion 11 of the female terminal 10 abuts on the electrical sensor 23 of the female connector 2. Accordingly, the each male terminal 31 is completely connected to the associated electrical connection portion 11 of the female terminal 10.

According to the female terminal 10 of the present invention, an excessive force exerted on the electrical connection portion 11 in the connection direction F deforms the bent portion 12 and is then dispersed. This configuration prevents the locking portion 14 of the parallel portion 13 from exerting the force and disengagement thereof from the female housing 21. The only engagement of the locking portion 14 with the female housing 21 assuredly prevents the disengagement of the terminal and improves the connection reliability of the connector 1. The configuration of the present invention does not exert the force on the lance 22 of the female housing 21. Thereby, the lance 22 can be miniaturized and the connector 1 can also be miniaturized and be lightweight.

The present invention prevents displacement of the parallel portion 13 and the current measurement portion 15 when the female terminal 10 and the male (mating) terminal 31 are contacted together. Thereby, the current measurement portion 15 and the current sensor 23 are held in place each other and assure the correct measurement of the current.

The configuration of the connector 1 prevents the force exerted on the lance 22 of the female housing 21 when the connector 1 is assembled. The connector 1 of the present invention prevents the female terminal (direct mount connector terminal) 10 from disengaging from the female housing 21 and provides the improved reliability of the connection. Thereby, the lance 22 of the female housing can be miniaturized and the connector 1 can also be miniaturized and be lightweight.

The embodiment of the present invention describes the direct mount connector terminal of the female terminal 10. The present invention is not limited thereto and it is apparent that a direct mount connector terminal of the male terminal 31 has also the same functional effect.

The embodiments described above are only exemplary and are not limited thereto. It is apparent that any alteration or modification is within the scope of the present invention.

INDUSTRIAL APPLICABILITY

According to the present invention, the bent portion deforms itself and disperses the force exerted on the electrical connection portion in the connection direction. This configuration prevents the locking portion of the parallel portion from being subjected to the force and from disengaging from the connector housing. The locking between the direct mount connector terminal and the connector housing prevents the disengagement of the terminal when they are connected together, and improves the reliability of the connection of the connector. This configuration does not exert the force on the lance of the connector housing, and the lance can thus be miniaturized and the connector can be miniaturized and lightweight.

The present invention prevents the displacement of the parallel portion and the electrical measurement portion when the direct mount connector terminal contacts the mating terminal. The electrical measurement portion can thus be held in place with respect to the electrical measurement device such as the current sensor so that the current is assuredly measured.

According to the present invention, the lance of the connector housing is not subjected to the force when the connector is fitted and the disengagement of the direct mount connector terminal from the connector housing is prevented. The connection reliability is thus improved, and the lance of the connector housing can be miniaturized and the connector can be miniaturized and lightweight.

The invention claimed is:

1. A direct mount connector terminal to be locked to a connector housing with a lance of the connector housing, comprising:

an electrical connection portion extending toward a connection direction of a mating terminal;

a bent portion connected to and bent with respect to the electrical connection portion;

a parallel portion connected to the bent portion and parallel to the electrical connection portion;

a locking portion disposed on the parallel portion and to be locked to the lance of the connector housing; and a current measurement portion connected to the parallel portion at a substantially fight angle and allowing measurement of a current flowing the direct mount connector terminal;

wherein the bent portion, the parallel portion and the current measurement portion are plate shaped.

2. A direct mount connector having the direct mount connector terminal and the connector housing as claimed in claim 1, wherein the connector housing has the lance to be locked to the locking portion of the direct mount connector terminal.

3. A direct mount connector having the direct mount connector terminal and the connector housing as claimed in claim 1, wherein the connector housing has the lance to be locked to the locking portion of the direct mount connector terminal.

* * * * *